US007111618B1

(12) United States Patent
Walker

(10) Patent No.: US 7,111,618 B1
(45) Date of Patent: Sep. 26, 2006

(54) RADIAL STATOR AND FLYWHEEL ASSEMBLY

(75) Inventor: James M. Walker, Fond du Lac, WI (US)

(73) Assignee: R.E. Phelon Company, Inc., Aiken, SC (US)

( * ) Notice: Subject to any disclaimer, the term of this patent is extended or adjusted under 35 U.S.C. 154(b) by 0 days.

(21) Appl. No.: 10/283,577

(22) Filed: Oct. 29, 2002

Related U.S. Application Data

(60) Provisional application No. 60/341,042, filed on Oct. 29, 2001.

(51) Int. Cl.
*F02P 1/02* (2006.01)

(52) U.S. Cl. ..... 123/599; 123/149 D

(58) Field of Classification Search ..... 123/149 A, 123/149 D, 599
See application file for complete search history.

(56) References Cited

U.S. PATENT DOCUMENTS

| | | | | | |
|---|---|---|---|---|---|
| 4,160,435 | A | * | 7/1979 | Sleder | 123/149 D |
| 4,873,962 | A | * | 10/1989 | Safranek | 123/599 |
| 4,892,079 | A | * | 1/1990 | Umezu et al. | 123/599 |
| 5,161,496 | A | * | 11/1992 | Matsushima et al. | 123/149 D |
| 5,477,841 | A | * | 12/1995 | Trost et al. | 123/599 |
| 5,704,338 | A | * | 1/1998 | Andersson et al. | 123/149 D |

* cited by examiner

*Primary Examiner*—Erick Solis
(74) *Attorney, Agent, or Firm*—Nicholas A. Kees; Godfrey & Kahn, S.C.

(57) ABSTRACT

The present invention provides a complete ignition and charging system in one assembly for an internal combustion engine that includes a multiple pole radial air gap stator and flywheel assembly with ignition and regulator circuitry mounted to the stator and the flywheel having a plurality of openings extending therethrough.

47 Claims, 20 Drawing Sheets

10283577.102902

RADIAL STATOR AND FLYWHEEL ASSEMBLY

CROSS-REFERENCE TO RELATED APPLICATIONS

This application is based on and claims priority from U.S. Provisional Application No. 60/341,042, filed Oct. 29, 2001.

BACKGROUND OF THE INVENTION

The present invention relates generally to an ignition and charging system for an internal combustion engine, and more particularly to a multiple pole radial air gap stator and flywheel assembly with ignition and regulator circuitry mounted to the stator and the flywheel having a plurality of openings extending therethrough.

The electrical system of a small internal combustion engine typically comprises an ignition system and a charging system. The ignition system is responsible for starting the engine. Whether the engine is started with a tug on a rewind rope or the turn of a key on an electric starter motor, the ignition system produces a spark inside the combustion chamber of the engine. As shown in FIG. 1, a prior art ignition system 10 generally includes a flywheel 12 with a plurality of magnets 14 mounted in the sidewall 16 of the flywheel, an ignition armature 18 mounted adjacent to the flywheel, at least one spark plug 20, and a spark plug cable 22 connecting the ignition armature to the spark plug. With each turn of the flywheel, the magnets mounted in the sidewall of the flywheel pass the ignition armature, creating a magnetic field and inducing a current in the armature to produce a high-voltage spark at the tip of the spark plug. The ignition system is coordinated with the timing of the piston and the motion of the valves so that the spark will ignite the air-fuel mixture in the combustion chamber just as the piston reaches the point of maximum compression in each engine cycle. Once the engine is running, the flywheel's inertia keeps the engine crankshaft spinning until the piston's next power stroke, while the flywheel magnets keep inducing a current in the armature to keeps the spark plug firing.

The charging system is responsible for keeping the battery charged for starting the engine and powering accessories. As shown in FIG. 2, a prior art charging system 24 generally includes an stator 26, a rectifier, a regulator, or combination rectifier/regulator 28, a battery 30, and wires 32 connecting the stator to the rectifier/regulator and wires 34 connecting the rectifier/regulator to the battery. The stator 26 includes a plurality of copper windings 36 wound around its poles 38 and is mounted under a flywheel with a plurality of magnets mounted in the sidewall of the flywheel. Rotation of the flywheel creates a magnetic field and induces a current in the copper windings of the stator. The rectifier converts AC power from the stator to DC power for charging the battery. The regulator maintains a steady voltage output. On some engines, the stator comprises an adjustable armature mounted outside of the flywheel that relies on the same magnets as the ignition armature to charge the battery. Limited amounts of current and DC voltage are produced, and a capacitor is used to handle fluctuations in the voltage output.

The present invention provides a complete ignition and charging system in one assembly that has many improvements and advantages over prior art systems.

SUMMARY OF THE INVENTION

The present invention provides a stator comprising a plurality of poles extending radially outwardly from a central core. The stator of the present invention preferably includes 24 poles, while prior art stators have a maximum of 18 poles. Most typical prior art stators generally have 8, 10, 12 or 18 poles. The stator of the present invention also preferably includes a plurality of stator pole lengths, the various pole lengths providing for different coil windings used for several different applications. The different coil windings on the stator can be applied to ignition charging applications as well as battery charging applications.

The stator preferably includes 24 poles, which are shorter and closer together than prior art stators having 18 poles. The stator lamination steel is stamped to provide shorter poles and more center steel area for lower magnetic flux resistance. The present invention thus provides less waste from stamping of the stator lamination steel because the 24 poles are shorter and closer together. The stator lamination steel is stamped to provide more center steel area for use in mounting controlling electronic circuits. There is more steel in the central core of the stator to mount the ignition and regulator circuitry within openings in the central core of the stator underneath the flywheel. Rectangular shaped openings in the center of the stator are provided for mounting ignition circuitry and voltage regulator circuitry on the stator. The regulator circuitry includes a finned heat sink for better cooling. Ignition circuitry is provided on the stator for engines having at least one or a plurality of cylinders. Sufficient area is provided on the stator for mounting two half-wave voltage regulator circuits, which can be connected together to form a full-wave voltage regulator circuit for battery charging purposes. Mounting the ignition and regulator circuitry to the stator provides a complete charging and ignition system in one assembly. This mounting yields cost savings for engine manufacturers by providing fewer components to assemble, increased production, and reduced labor costs.

Mounting the ignition and regulator circuits on the stator results in fewer interconnects of wiring harnesses on the final application, by eliminating terminal connections between the voltage regulator circuitry and the stator. The assembly of the present invention provides a direct connection from the regulator circuitry to the windings. There is no longer a need for connecting separate wires to the windings.

The ignition circuitry provides a more versatile ignition system allowing the engine to burn fuels other than gasoline, for example, propane. The more versatile ignition system includes a microprocessor-controlled ignition that permits software changes to provide for customer needs. The microprocessor-controlled ignition uses a ramp-and-fire-type ignition coil charging system that allows for changing the current levels to which the coil charges, thus providing higher energy levels, higher coil open circuit output levels, and longer ignition spark durations. The longer spark durations provide a more thorough burning of the fuel-air mixture in the engine, resulting in lower emissions and improved pollution control. The more versatile ignition system also provides for advancing the ignition spark, which improves power output from the engine.

The ignition circuitry also provides for ignition triggering through the use of a Hall Sensor, thus simplifying manufacturing and thereby reducing the cost of the system, by eliminating small air gaps and tight tolerances on components. The ignition trigger includes a magnet for ignition triggering mounted on the inside of the flywheel.

The 24-pole stator achieves sufficient output with fewer turns of copper wire wound on each pole of the stator. For 18-pole stators, there are generally two layers of wire wound on the poles. For the 24-pole stator of the present invention, there is only one layer of wire wound on the poles to get the same output. This single layer of wire windings results in less heating of the copper wire at higher current levels. The stator thus stays cooler than prior art stators. The wire windings are further kept cool due to the fact that the increased number of poles provide more steel lamination surface area, for better heat dissipation. Thus, there are fewer windings per pole and the wires are spread out more on the poles, providing more surface area per wire and cooler performance.

The present invention also provides a flywheel having a plurality of openings extending through the flywheel for providing more airflow through and around the engine crankcase, resulting in better cooling of the engine. These openings further result in a flywheel with less weight and lower inertia. The openings in the flywheel (referred to as spokes) provide airflow down through the stator mounting area and crankshaft bearings and seals. The lower inertia flywheel provides for faster acceleration of the engine for racing purposes, and provides for faster deceleration of the engine for safety reasons. The flywheel also provides for improved manufacturability, allowing for a more symmetrical flywheel. There is less machining required on the flywheel because of the absence of the external magneto ignition magnet mounting area that is typically found on most prior art flywheels. The manufacturing improvements also include a reduced necessity of balancing the flywheel, because of the symmetrical nature of the flywheel.

The present invention also contemplates a method of manufacturing the radial stator and flywheel assembly.

The present invention comprises a stator having more poles than prior art stators, which typically have 8, 10, 12 or 18 poles. The stator has 24 poles instead of the typical prior art maximum of 18. With 18 pole stators, you typically have to wind two layers of wire on the poles. With the 24 pole stator, you have fewer windings with only one layer of wire on the poles. There is less waste from the stamping of the stator lamination steel, because the 24 poles are shorter and closer together. The stator lamination steel is stamped to provide shorter poles and more center area for lower magnetic flux resistance. Ignition and regulator circuitry is mounted to the stator. Mounting ignition and regulator circuitry on stator provides direct connection to windings, so there is no need for connecting wires. The larger center steel area is used for mounting controlling electronic circuits thereon, such as an ignition circuit for an engine having a plurality of cylinders and half wave voltage regulator circuits for battery charging. Two half wave regulator circuits can be mounted on the stator to form a full wave regulator circuit for battery charging. The present invention provides for fewer interconnects of wiring, eliminating terminal connections between the voltage regulator and the stator. The present invention also provides for fewer turn of copper wire wound on each pole of the stator, allowing for less heating of the copper at higher current levels. The plurality of poles provide more steel lamination surface area for better cooling. The stator also provides a plurality of stator pole lengths, providing for different coil windings for different applications. For example, the stator can have windings for battery-less ignitions of All Terrain Vehicle types and high current coils wound for vehicle lights and other accessories. The stator having an opening for the ignition circuitry and two openings for two half wave rectifiers.

The flywheel includes a plurality of openings extending through the flywheel to provide more airflow through and around the engine crankcase for better cooling of the engine. The openings reduce weight, lower inertia, and increase air flow resulting in the engine running cooler by 40 to 50 degrees from prior art engines. The openings provide air flow down through the stator mounting area and crankshaft bearings and seals. The flywheel provides lower inertia (easier to start/stop engine/blade), faster acceleration of the engine for racing, faster deceleration of the engine for stopping the engine for safety reasons, better fuel economy, lower emissions, improved manufacturability (less machining, easier assembly), lower temperature, more horsepower, and a more symmetrical flywheel. The less machining is due to the absence of external magneto ignition magnet mounting areas. The manufacturing improvements also refer to not having to balance the flywheel because of the symmetrical nature of the flywheel.

The present invention provides a more versatile ignition system allowing the engine to burn other types of fuels, other than gasoline, like propane. The ignition system is a microcontroller controlled ignition allowing software changes to be made to accommodate customer needs. The ignition system uses a ramp and fire type ignition coil charging system that allows for changing the current levels to which the coil charges, thus providing higher energy levels, higher coil open circuit output kilovolt levels and longer ignition spark durations. The ignition system provides for advancing the ignition spark which provides horsepower gains from an engine. The ignition system also provides longer spark durations which provide more through burning of the air-fuel mixture resulting in lower emissions for pollution control. The present invention also provides for ignition triggering by the use of a Hall Sensor, thus making manufacturing simpler and less costly by eliminating small air gaps and tight tolerances. With ignition circuitry mounted on stator you eliminate the magnet on the flywheel. Magnet for ignition trigger is mounted to stator. Therefore, flywheel doesn't require magnets.

Some of the benefits of the radial stator and flywheel assembly of the present invention are that it: 1) is easier to assemble and mount than prior art systems, 2) provides better fuel economy, 3) results in a cooler running engine, 4) increases engine horsepower, 5) provides the engine with the ability to burn multiple types of fuels, 6) reduces emissions, and 7) provides better acceleration and deceleration of the engine.

Various other features, objects, and advantages of the invention will be made apparent to those skilled in the art from the accompanying drawings and detailed description thereof.

DETAILED DESCRIPTION OF THE INVENTION

Figure 1:
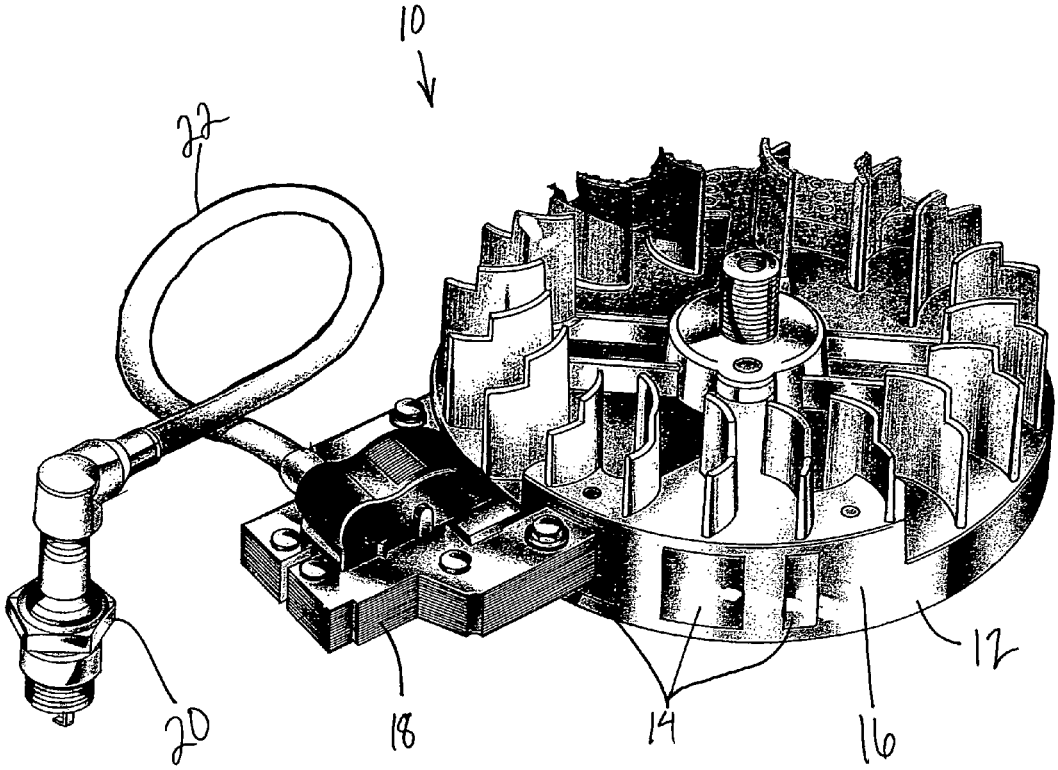
FIG. 1 PRIOR ART
FIG. 1 is a perspective view of a prior art ignition system.
Figure 2:
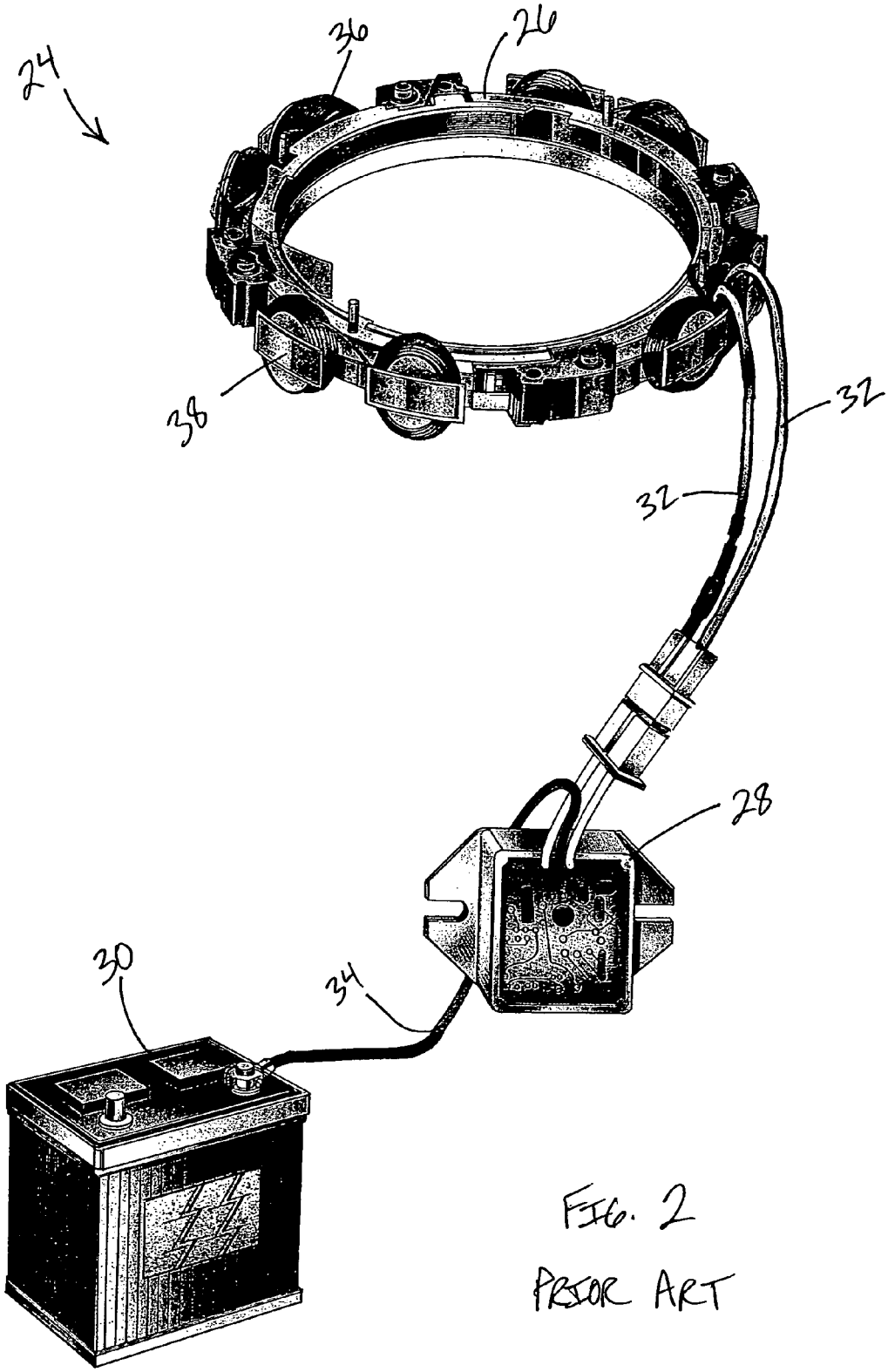
FIG. 2 PRIOR ART
FIG. 2 is a perspective view of a prior art charging system.
Figure 3A:
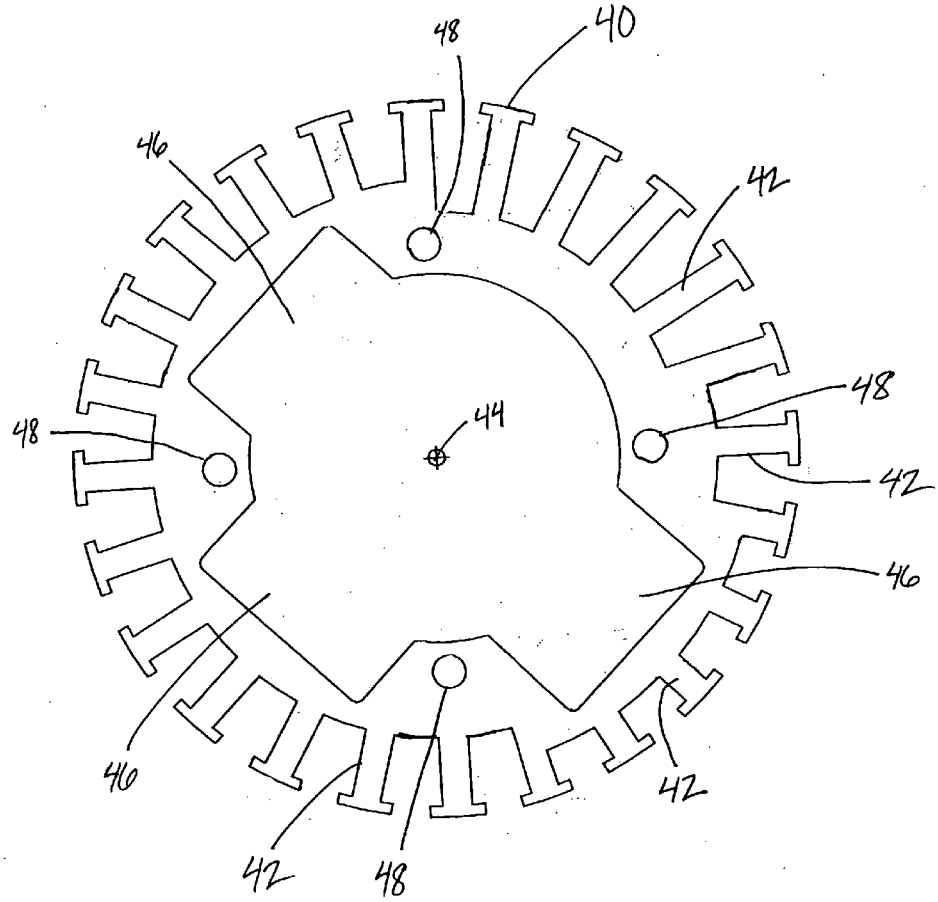
FIG. 3A is a top view of one embodiment of a stator of the present invention.

Referring to the drawings, FIG. 3A is a top view of one embodiment of a stator 40 of the present invention. The stator is preferably mounted to the crankshaft of an internal combustion engine, underneath a flywheel which rotates around the poles of the stator.

The stator 40 of the present invention preferably comprises a plurality of poles 42, preferably at least 24, extending radially outwardly from a central core 44. The plurality of poles provide more steel lamination surface area for better cooling. The stator lamination steel is stamped to provide shorter poles and a larger central core for lower magnetic flux resistance. There is also less waste from the stamping of the stator lamination steel, because the poles are shorter and closer together. The larger center steel area is used for mounting controlling electronic circuits thereon, such as ignition circuitry and regulator circuitry.

In the embodiment shown in FIG. 3A, the stator includes poles 42 having a variety of pole lengths. The outer radius of the stator is the same, while the internal radius of the central core may be different for different arc sections, resulting in a stator having poles with different pole lengths. The various pole lengths provide for different coil windings used for several different applications. The longer poles are preferably for winding coils for battery-less ignition applications, while the shorter poles are preferably for winding coils for high current battery charging applications. The stator 40 is preferably stamped from lamination steel, thus providing more poles and more center steel area and at the same time lower magnetic flux resistance. The stator lamination steel is stamped to provide a plurality of openings 46 for mounting ignition and regulator circuitry on the stator. Ignition circuitry may be mounted in one of the openings 46, while the other openings 46 are provided for mounting voltage regulator circuitry. Mounting ignition and regulator circuitry on stator provides direct connection to the windings, eliminating the need for terminal connections between the stator and other circuitry. The circuitry is preferably mounted to the stator 40 in housings or modules attached to the stator using fasteners extending through mounting holes 48.

Figure 3B:
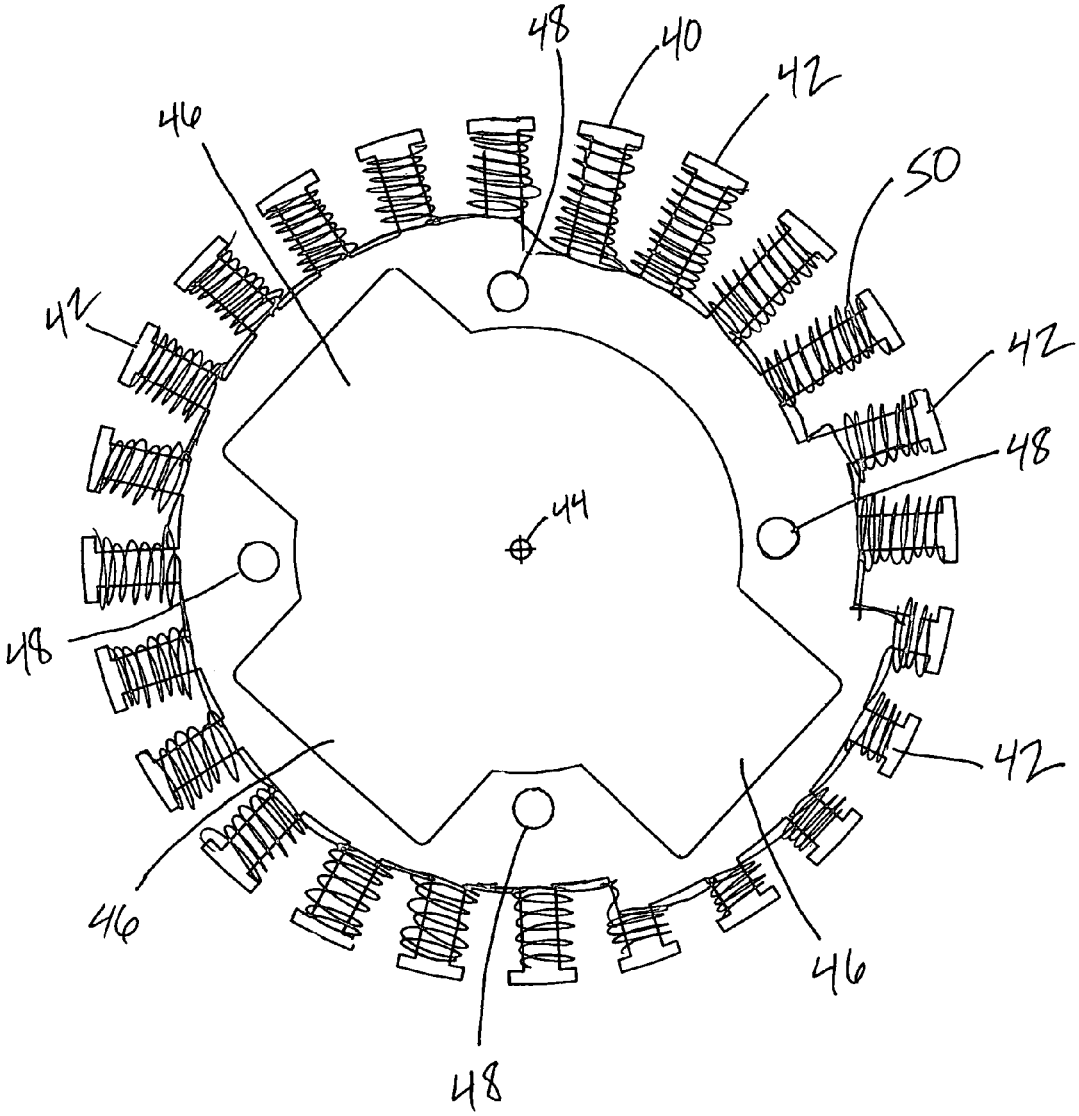
FIG. 3B is a top view of the stator of FIG. 3A shown with windings wound around its poles.
Figure 4A:
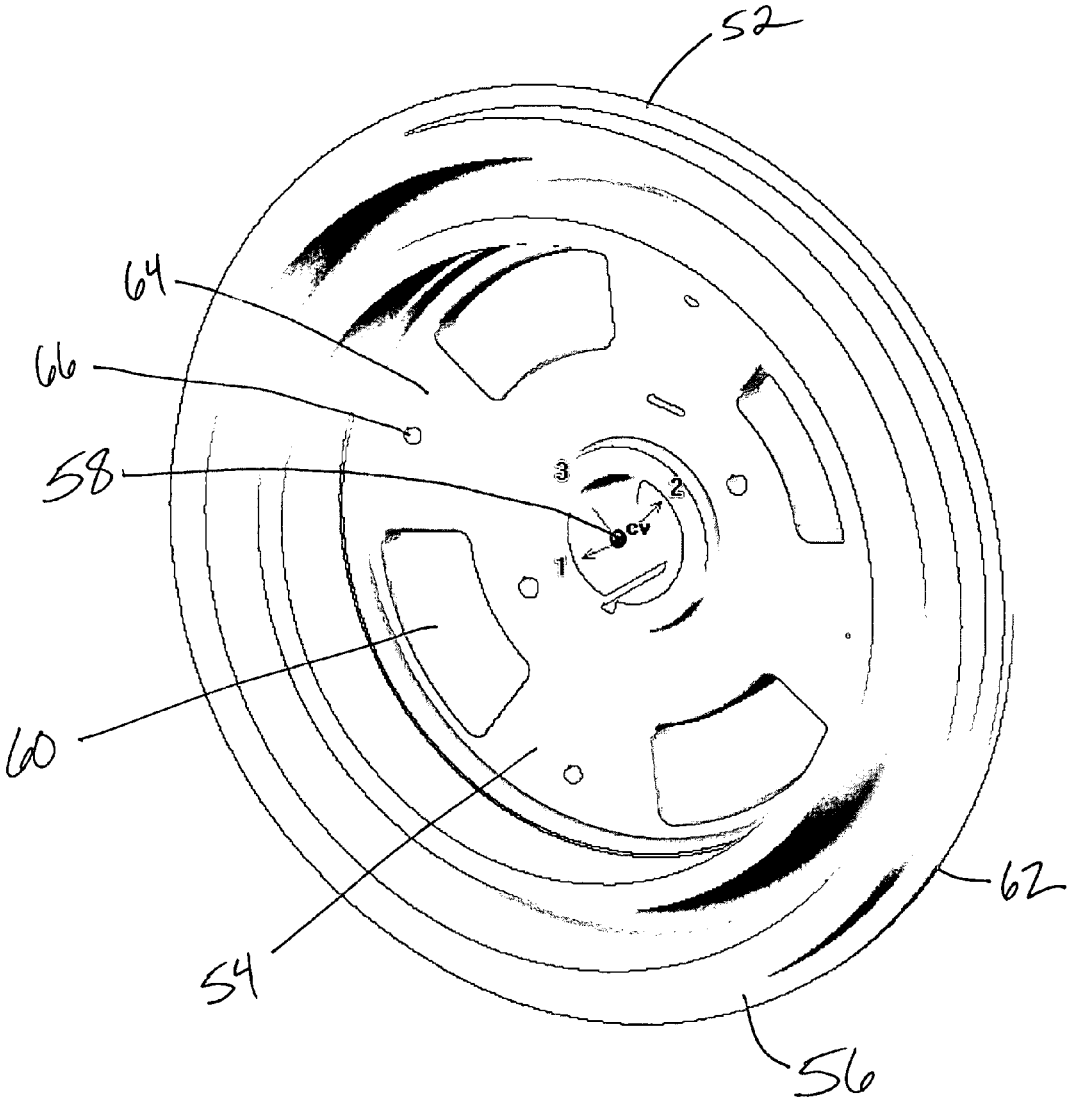
FIG. 4A is a perspective view of one embodiment of a flywheel of the present invention.
Figure 4B:
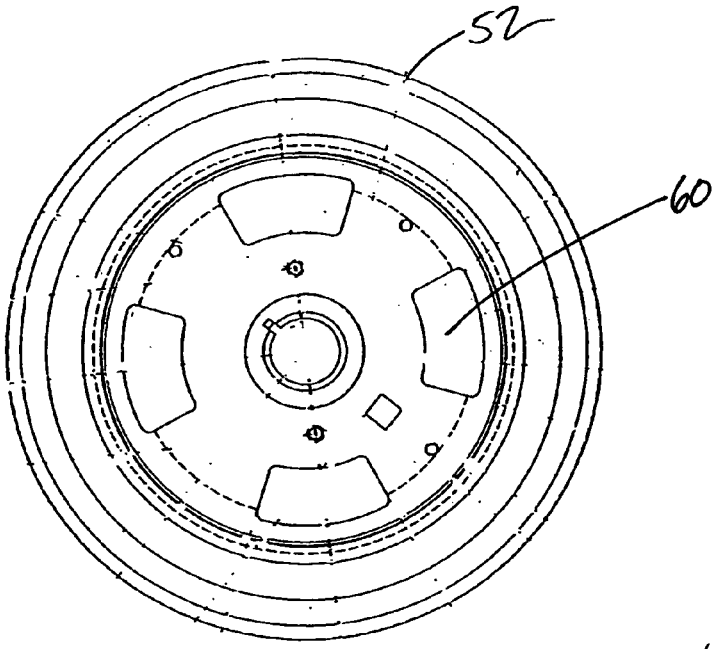
FIG. 4B is a top view of the flywheel of FIG. 4A.
Figure 4C:
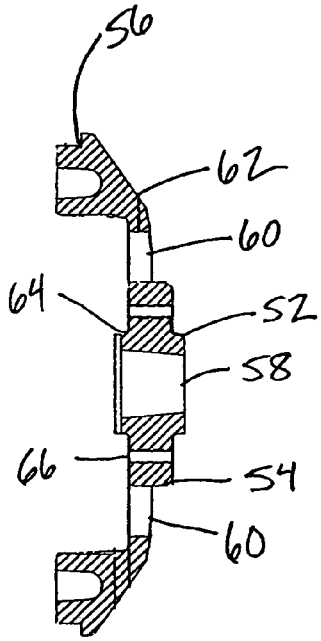
FIG. 4C is a cross-sectional view of the flywheel of FIG. 4A.
Figure 4D:
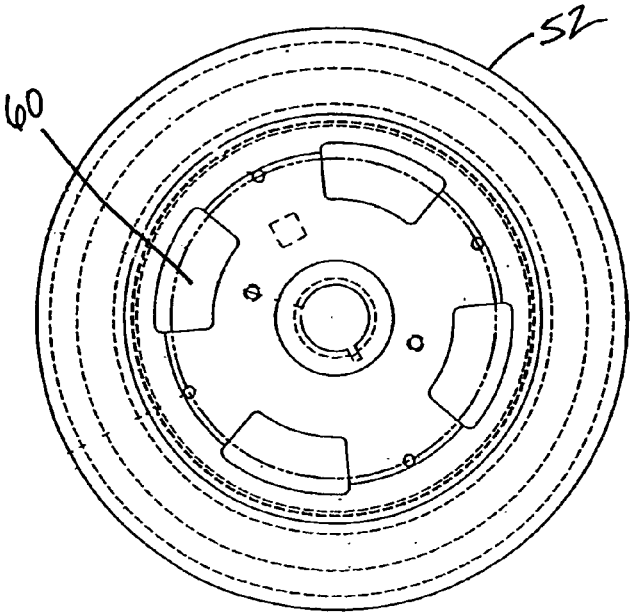
FIG. 4D is a bottom view of the flywheel of FIG. 4A.
Figure 5A:
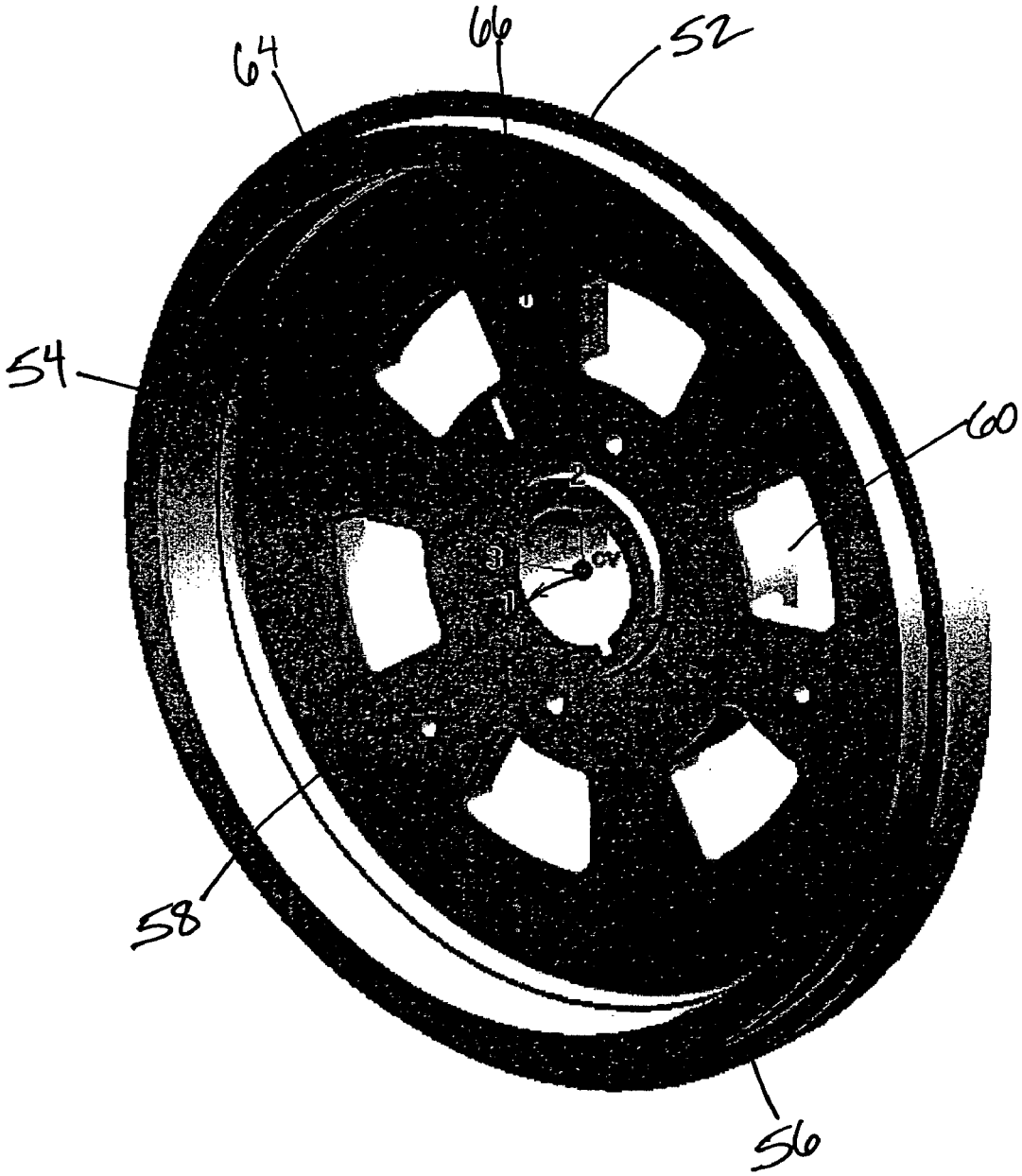
FIG. 5A is a perspective view of another embodiment of a flywheel of the present invention.
Figure 5B:
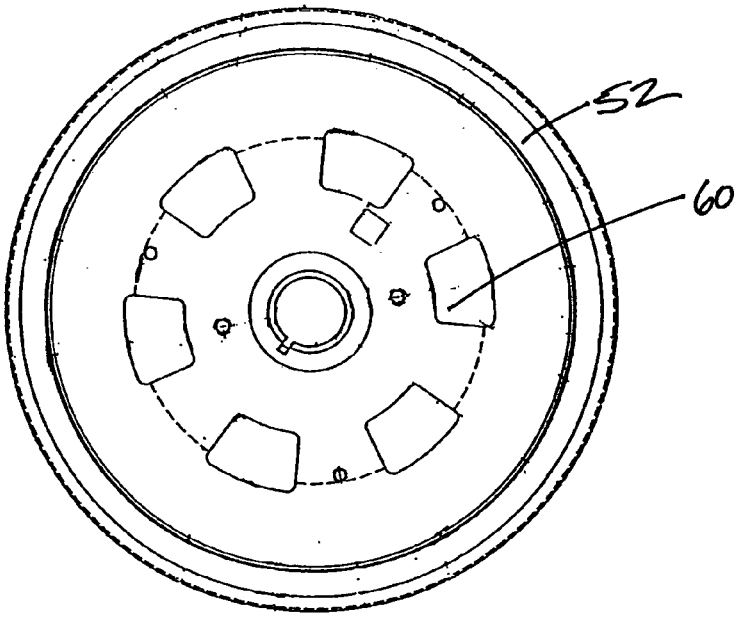
FIG. 5B is a top view of the flywheel of FIG. 5A.
Figure 5C:
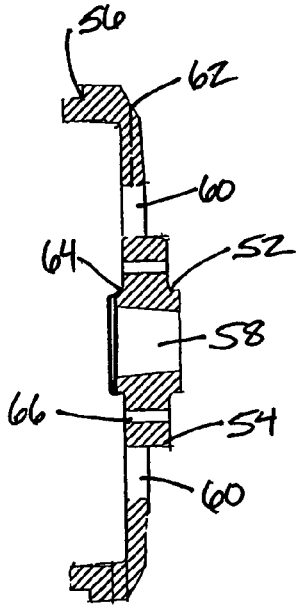
FIG. 5C is a cross-sectional view of the flywheel of FIG. 5A.
Figure 5D:
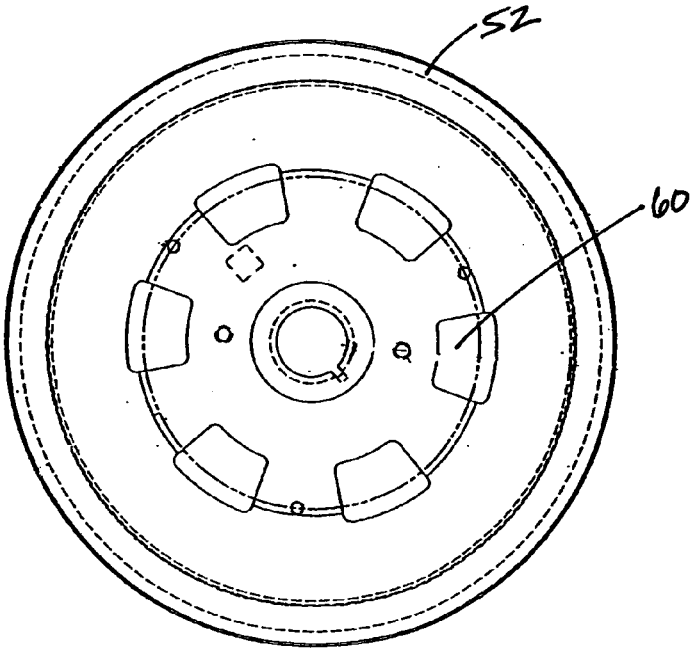
FIG. 5D is a bottom view of the flywheel of FIG. 5A.
Figure 6A:
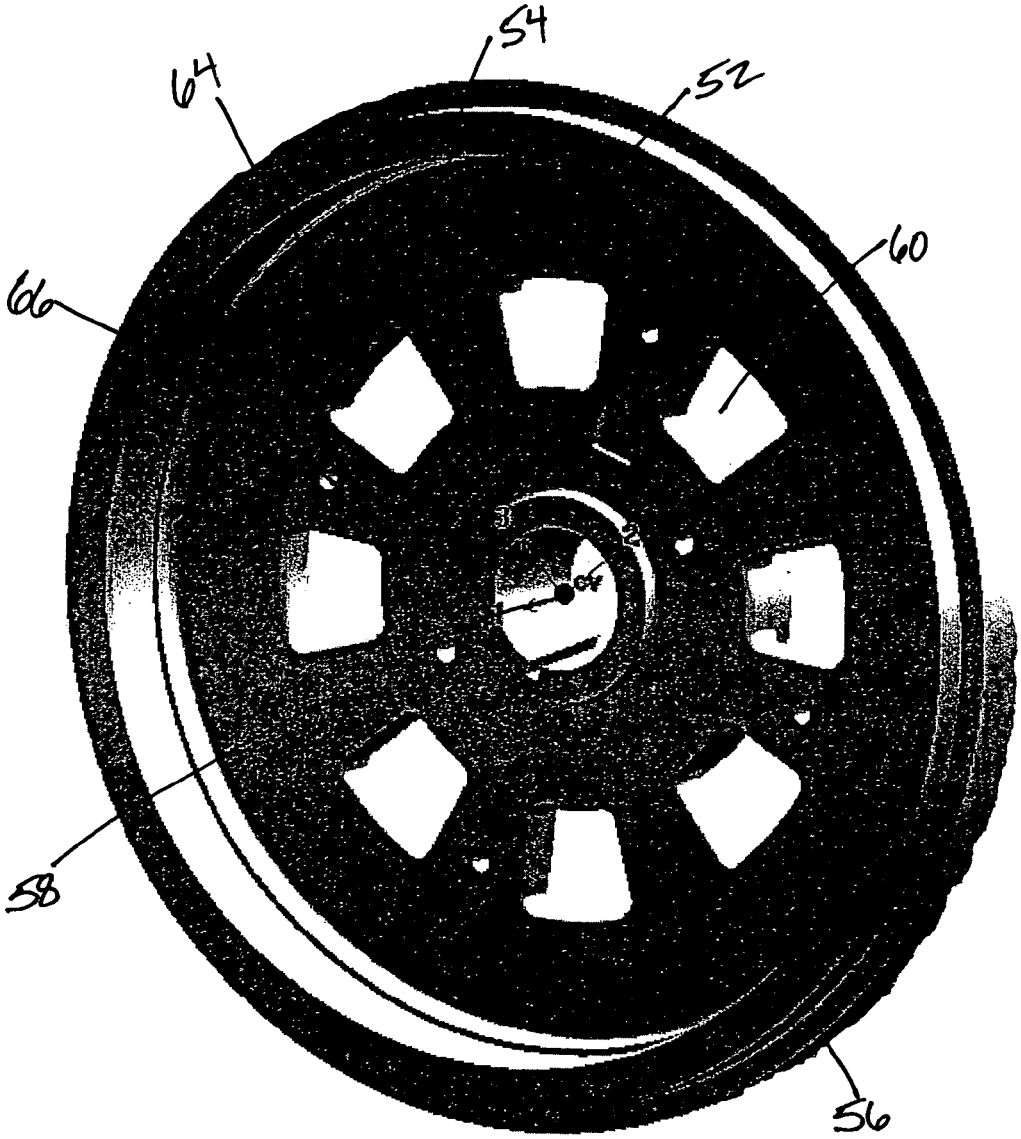
FIG. 6A is a perspective view of another embodiment of a flywheel of the present invention.
Figure 6B:
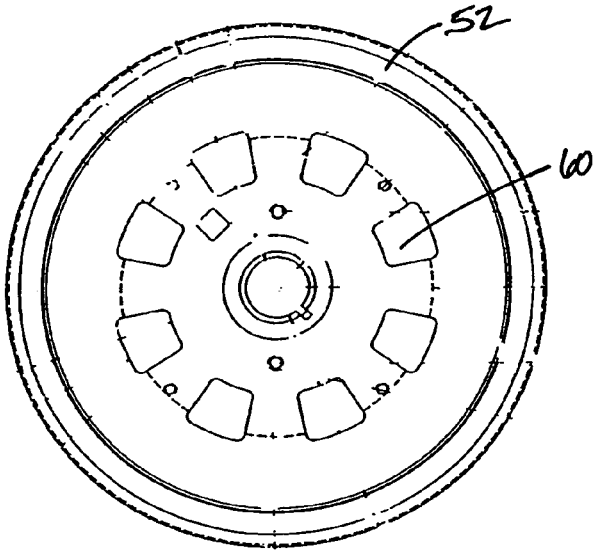
FIG. 6B is a top view of the flywheel of FIG. 6A.
Figure 6C:
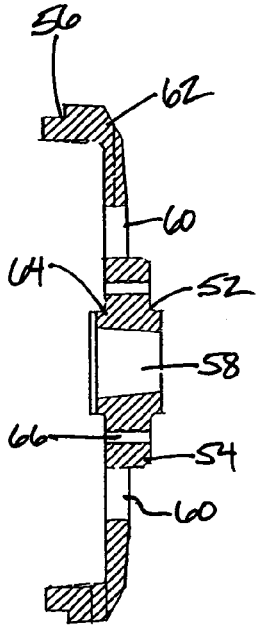
FIG. 6C is a cross-sectional view of the flywheel of FIG. 6A.
Figure 6D:
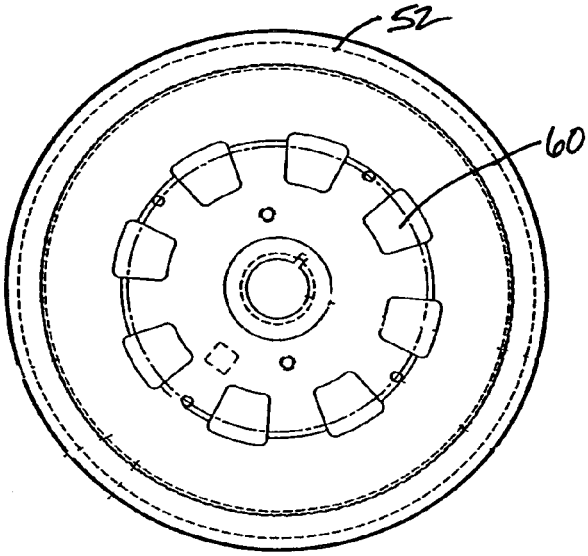
FIG. 6D is a bottom view of the flywheel of FIG. 6A.
Figure 7A:
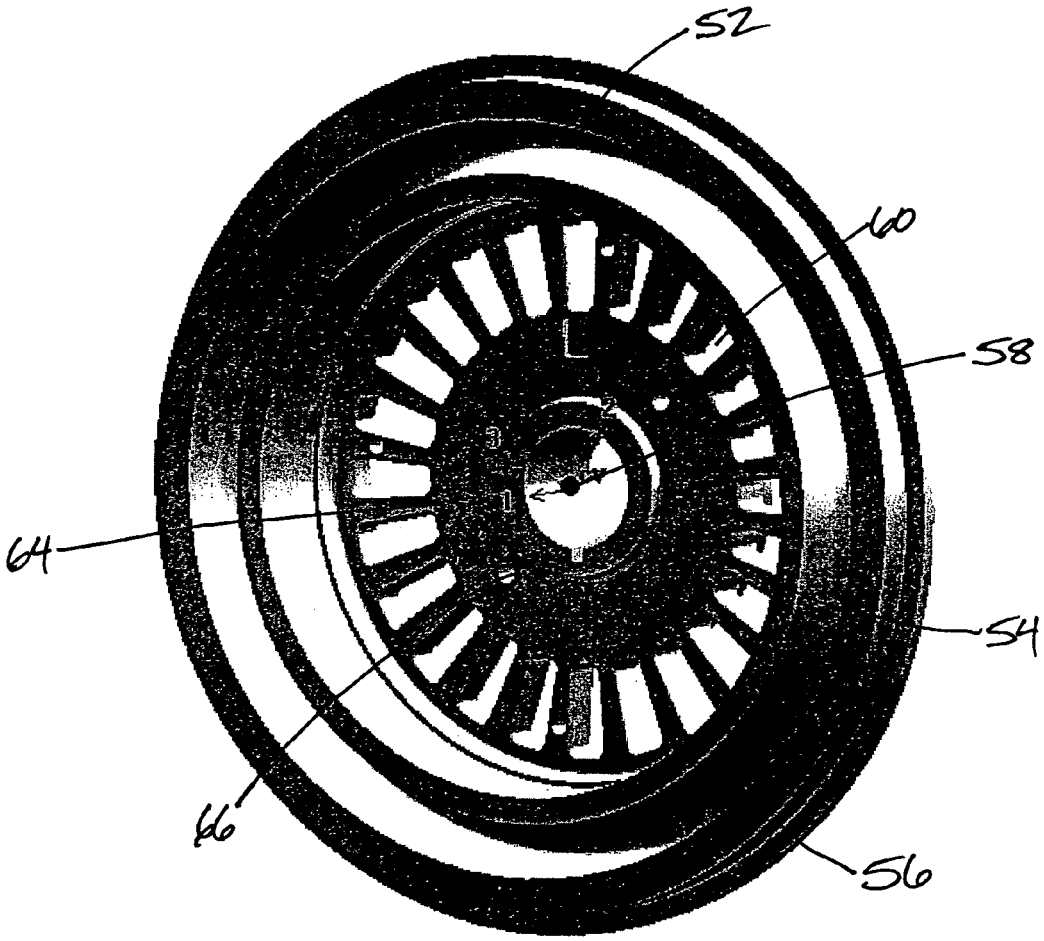
FIG. 7A is a perspective view of another embodiment of a flywheel of the present invention.
Figure 7B:
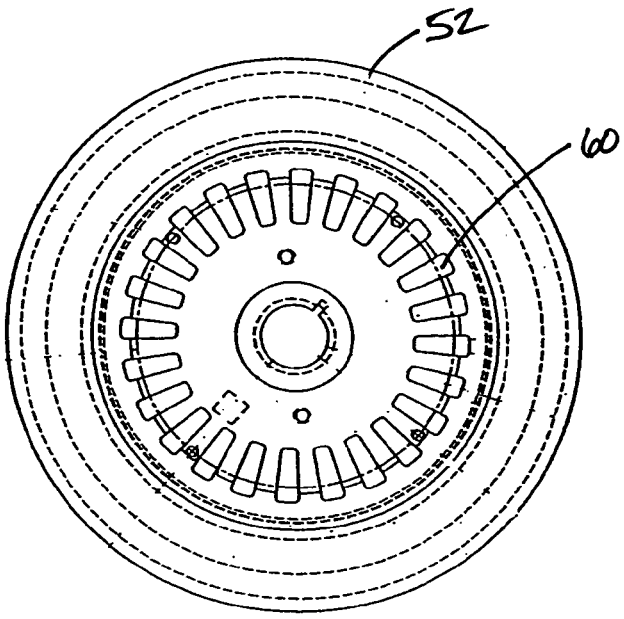
FIG. 7B is a top view of the flywheel of FIG. 7A.
Figure 7C:
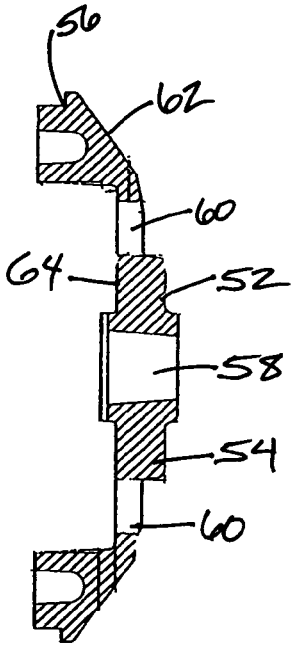
FIG. 7C is a cross-sectional view of the flywheel of FIG. 7A.
Figure 7D:
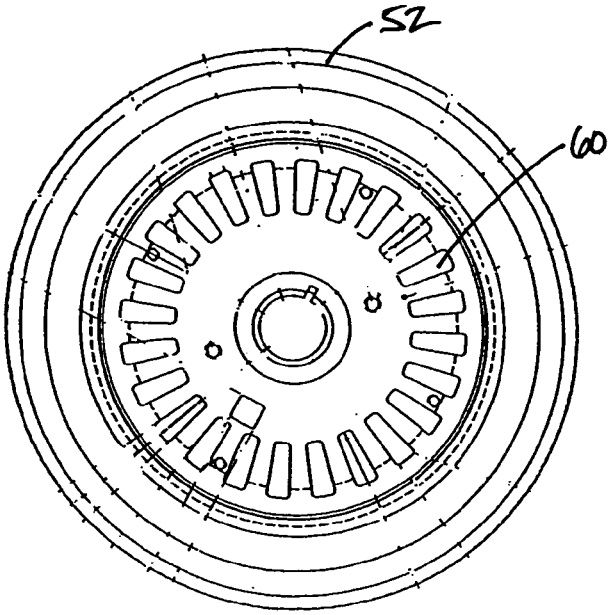
FIG. 7D is a bottom view of the flywheel of FIG. 7A.

In a preferred embodiment, the stator preferably includes 24 poles of the same length with turns of copper wire wound around each pole of the stator. FIG. 3B is a top view of the stator of FIG. 3A shown with windings 50 of copper wire wound around its poles 42. For the 24-pole stator of the present invention there is preferably only one layer of wire wound around each pole, allowing for less heating of the copper wire at higher current levels. Outputs wires extending from the stator are preferably connected to the regulator circuitry and the ignition circuitry. The output of the regulator is preferably connected to the positive terminal of the battery. Output wires from the ignition circuitry are preferably connected to spark plugs on the engine cylinders.

FIGS. 4A, 4B, 4C, and 4D illustrate different views of one embodiment of a flywheel 52 of the present invention. FIGS. 5, 6, and 7 illustrate different embodiments of the flywheel 52 of the present invention. The main difference being the number of openings 60 extending through the flywheel. The flywheel 52 is secured to the uppermost end of the crankshaft of the engine above the stator. The flywheel 52 is preferably cup-shaped with a central portion 54 and a flange 56 depending downwardly therefrom around the periphery of the flange. A central opening 58 extends through the center of the flywheel 52 for mounting the flywheel 52 to the crankshaft. The flywheel 52 is mounted to an engine on top of the stator, with the flange covering the stator. The flywheel 52 also preferably includes a plurality of smaller openings 66 extending therethrough.

The flywheel 52 comprises a substantially flat top surface 62, a cup shaped bottom surface 64, a plurality of openings 60 extending through the flywheel, a plurality of magnets mounted around the inner circumference of the cup shaped bottom surface 64 to coincide with the wire coils and poles of the stator, and at least one ignition trigger magnet mounted to the bottom surface to coincide with the ignition circuitry.

The flywheel 52 preferably includes a plurality of openings 60 extending through the flywheel. These openings 60 provide better airflow for cooling down through the stator mounting area and crankshaft bearings and seals, less mass, and thereby lower inertia. The lower inertia flywheel 52 provides for faster acceleration and deceleration of the engine. The flywheel 52 is also preferably symmetrical. The flywheel 52 is preferably mounted to the engine on top of the stator.

The flywheel 52 includes a plurality of openings 60 extending through the flywheel 52 to provide more airflow through and around the engine crankcase for better cooling of the engine. The openings 60 reduce weight, lower inertia, and increase air flow resulting in the engine running cooler by 40 to 50 degrees from prior art engines. The openings 60 provide air flow down through the stator mounting area and crankshaft bearings and seals. The flywheel 52 provides lower inertia (easier to start/stop engine/blade), faster acceleration of the engine for racing, faster deceleration of the engine for stopping the engine for safety reasons, better fuel economy, lower emissions, improved manufacturability (less machining, easier assembly), lower temperature, more horsepower, and a more symmetrical flywheel. The less machining is due to the absence of external magneto ignition magnet mounting areas. The manufacturing improvements also refer to not having to balance the flywheel 52 because of the symmetrical nature of the flywheel.

Figure 8:
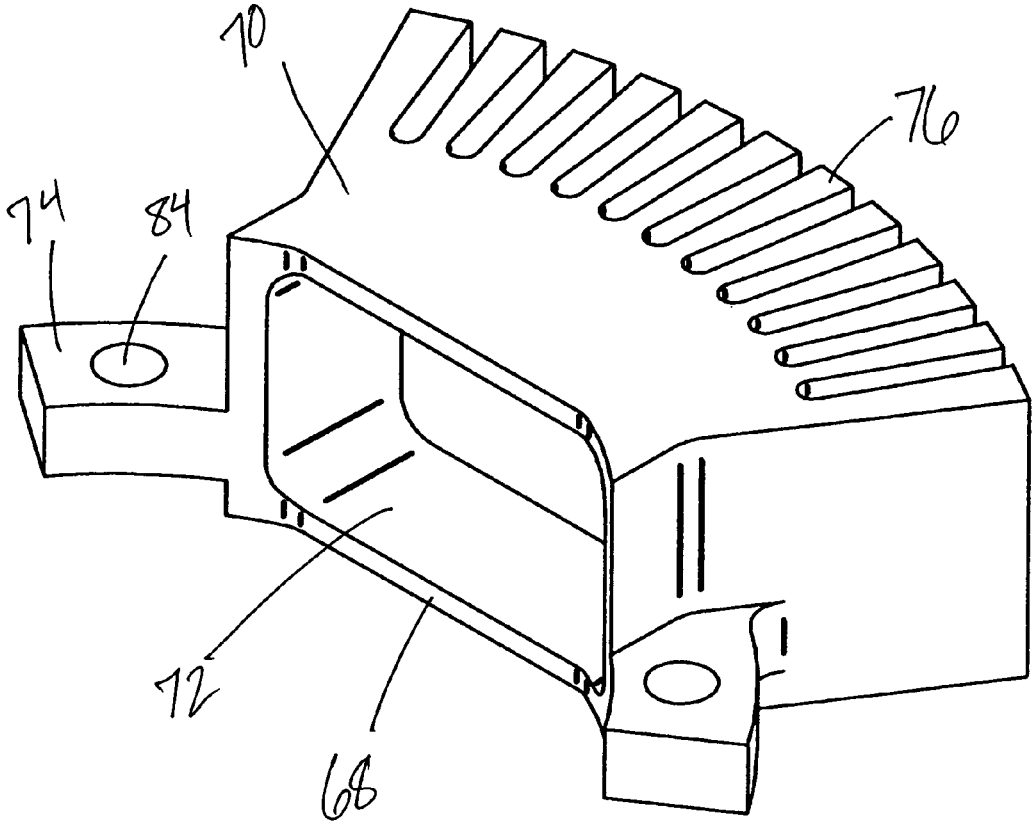
FIG. 8 is a perspective view of a regulator module of the present invention.

FIG. 8 is a perspective view of a regulator module 68 of the present invention. The regulator module 68 may be attached to a stator 80 for housing regulator circuitry 78 therein. The regulator module 68 preferably includes a main body 70 with an opening 72 extending therethrough for mounting regulator circuitry 78 therein a plurality of cooling fins 76 extending radially outwardly from the main body 70, and at least two attachment arms 74 extending from opposite sides of the main body 70 with at least one mounting hole 84 extending through each attachment arm 74 for mounting the module 68 to the stator 80.

Figure 9:
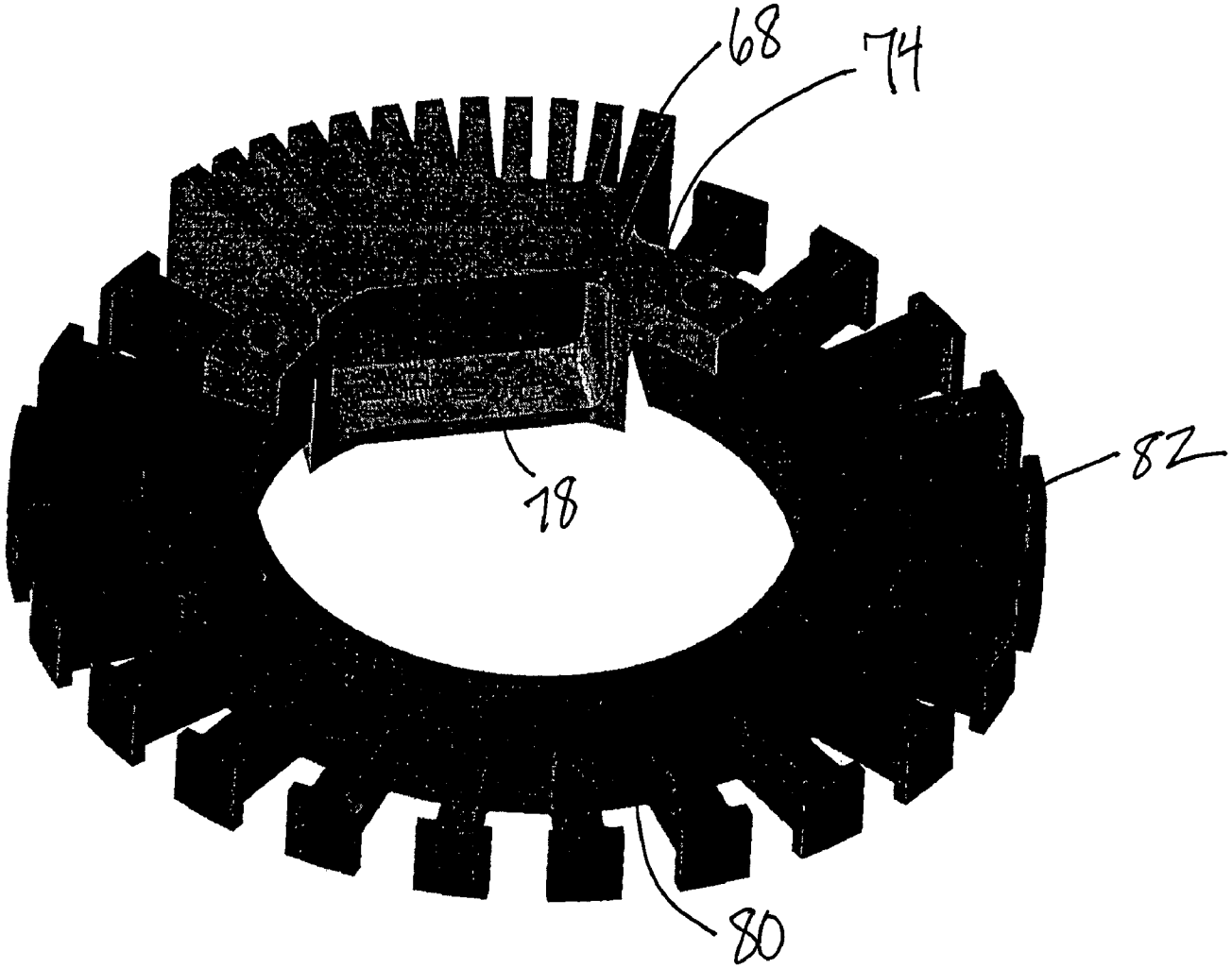
FIG. 9 is a perspective view of the rectangular module of FIG. 8 attached to a stator in accordance with an embodiment of the present invention.

FIG. 9 is a perspective view of the regulator module 68 attached to the stator 80 in accordance with an embodiment of the present invention. The regulator module 68 fits into an opening in the central core of the stator 80 and around the poles 82 extending radially outwardly from the central core of the stator.

Figure 10A:
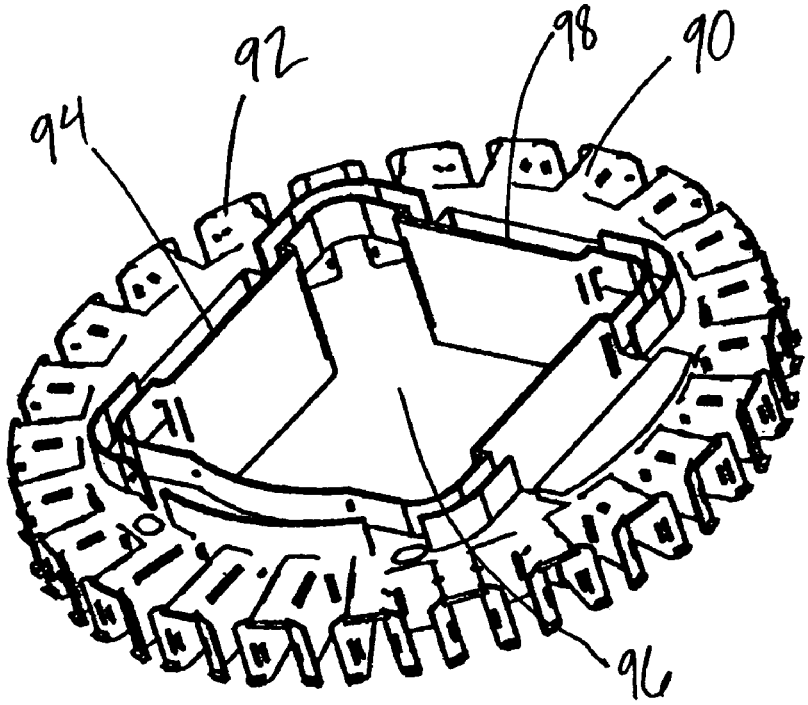
FIG. 10A is a perspective top view of one embodiment of a stator tray assembly of the present invention.
Figure 10B:
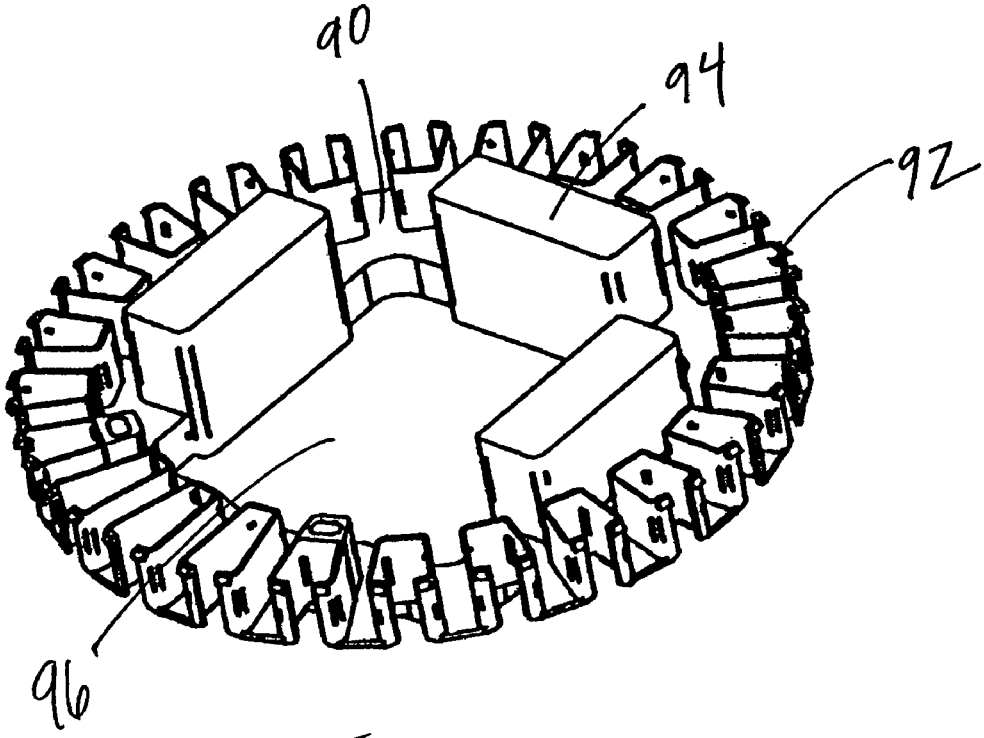
FIG. 10B is a perspective bottom view of the stator tray assembly of FIG. 10A.

FIG. 10A is a perspective top view of one embodiment of a stator tray assembly 90 of the present invention. FIG. 10B is a perspective bottom view of the stator tray assembly 90 of FIG. 10A. The stator tray assembly 90 preferably includes a central portion 94 with a plurality of pole portions 92 extending radially outwardly from the central portion 94 and a large opening 96 extending through the center of the assembly. The stator tray assembly 90 is designed to attach to the central core and poles of a stator.

Figure 11:
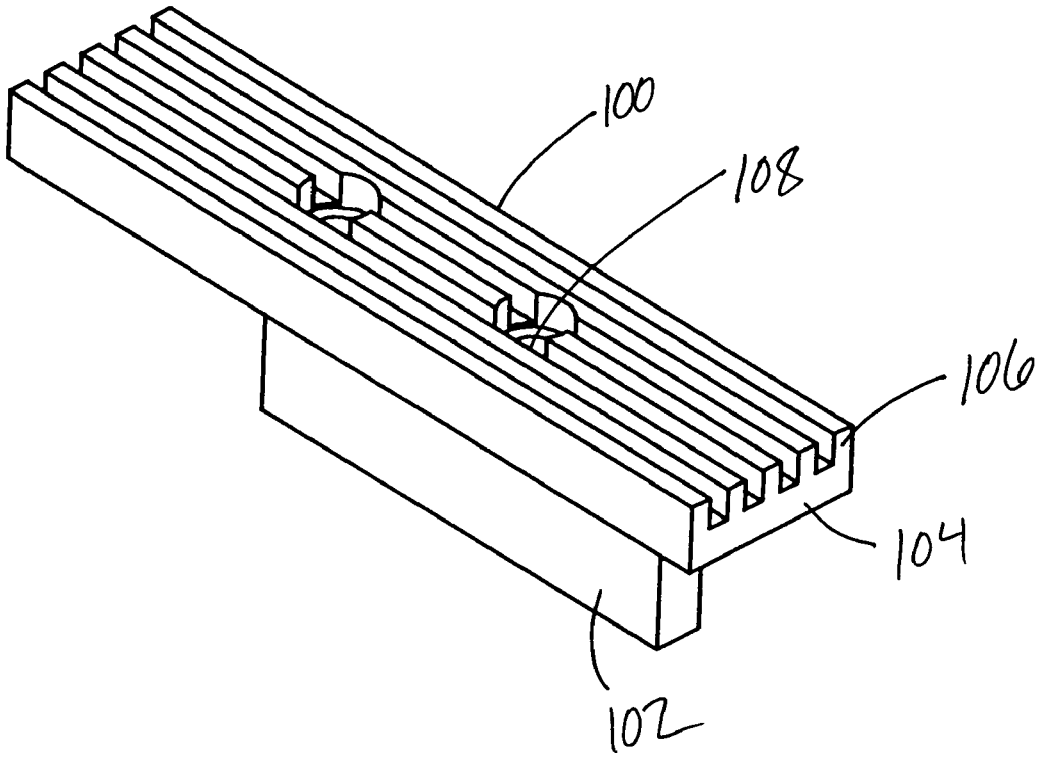
FIG. 11 is a perspective view of a regulator housing of the present invention.

FIG. 11 is a perspective view of a regulator housing 100 of the present invention. The regulator housing 100 preferably includes a vertical first member 102 designed to fit into openings 98 in the central portion 94 of the stator tray assembly 90 and a horizontal second member 104 that is attached to one side of the vertical first member 102. The horizontal second member 104 preferably includes a plurality of cooling fins 106 extending vertically upwardly from the top of the horizontal second member 104 and at least one opening 108 extending therethrough for attaching the regulator housing 100 to the stator tray assembly 90.

Figure 12A:
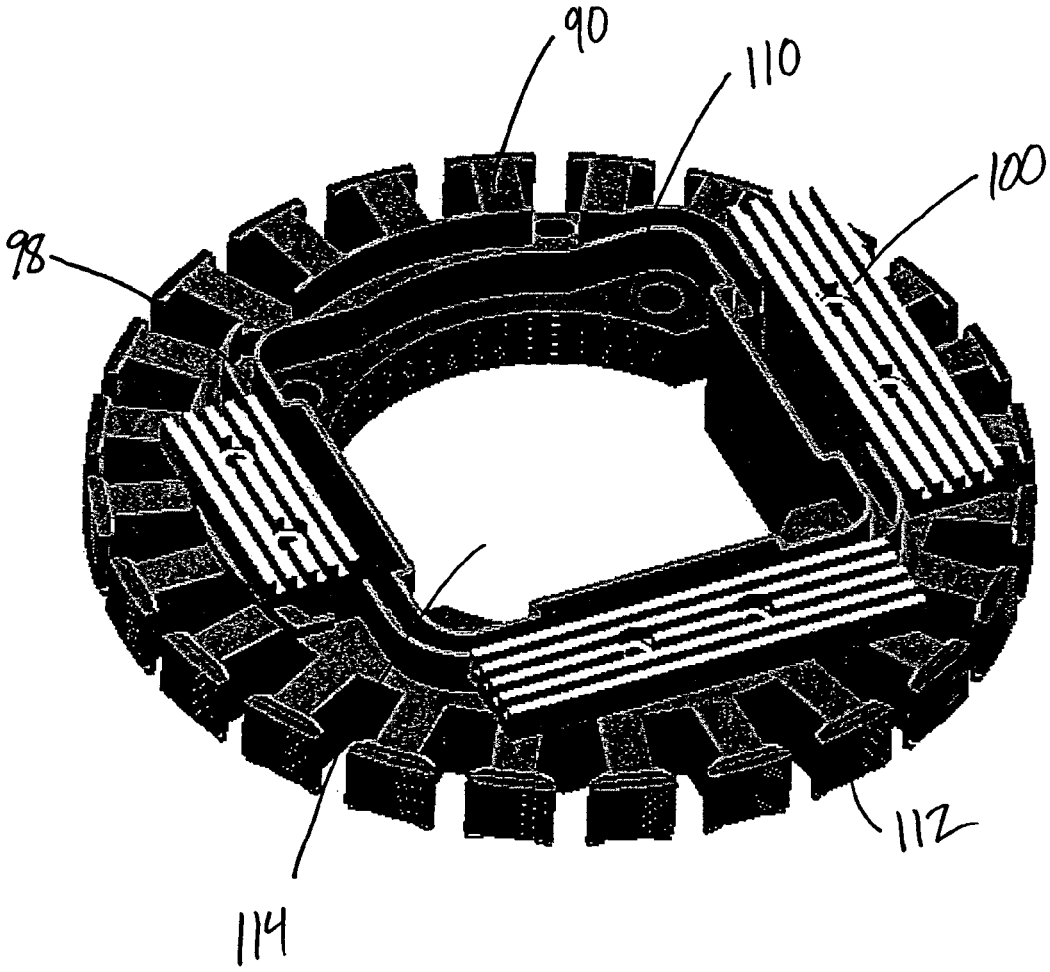
FIG. 12A is a perspective top view of the stator tray assembly of FIGS. 10A and 10B with a plurality of the regulator housings of FIG. 11 installed within the stator tray assembly in accordance with an embodiment of the present invention.
Figure 12B:
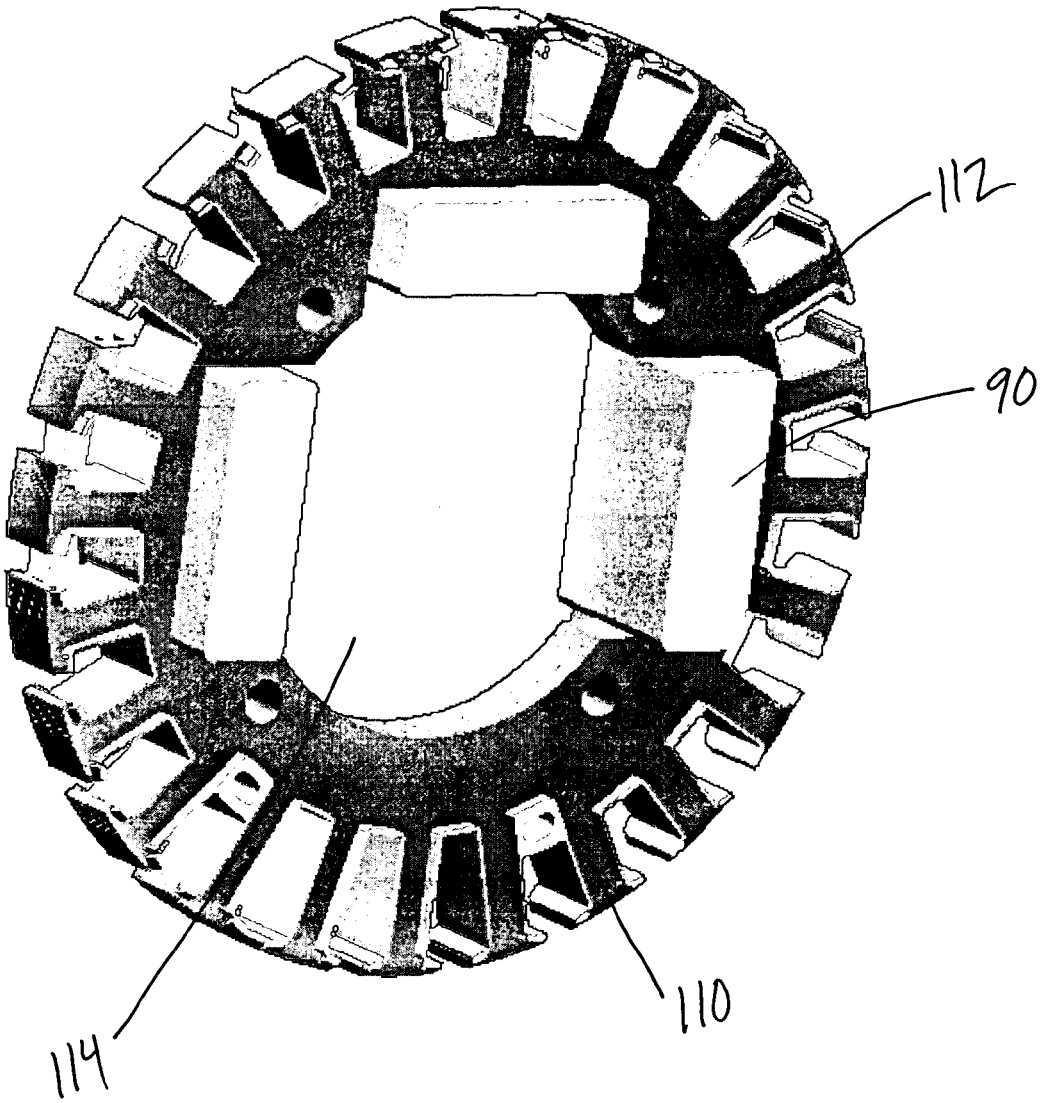
FIG. 12B is a perspective bottom view of the stator tray assembly of FIG. 12A.

FIG. 12A is a perspective top view of the stator tray assembly 90 of FIGS. 10A and 10B, and a plurality of the regulator housings 100 of FIG. 111 attached to the stator tray assembly 90 in accordance with an embodiment of the present invention. FIG. 12B is a perspective bottom view of the assembly of FIG. 12A. The stator tray assembly 90 preferably includes a central portion 110 with a plurality of pole portions 112 extending radially outwardly from the central portion 110 and a large opening 114 extending through the center of the assembly. The stator tray assembly 90 is designed to attach to the central core and poles of a stator.

Figure 13:
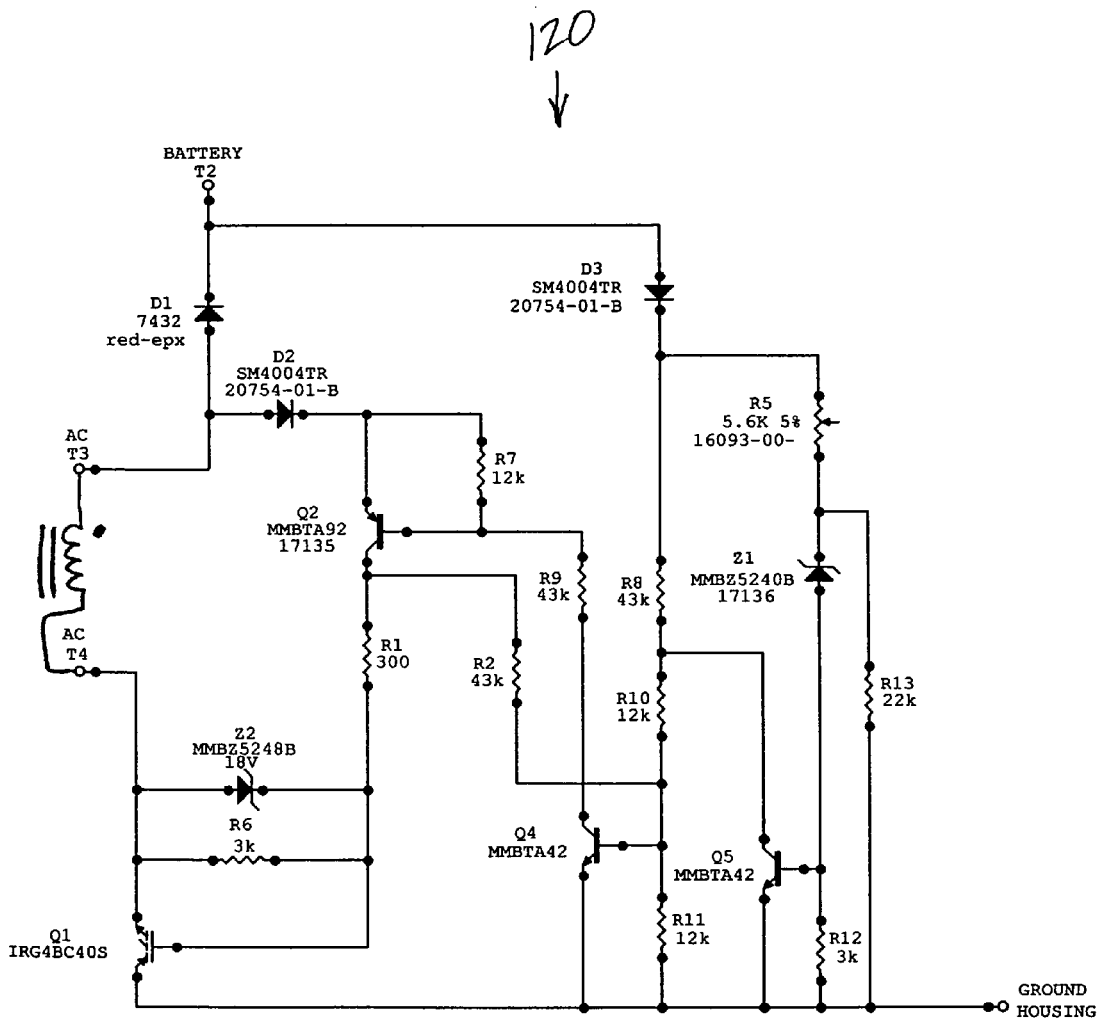
FIG. 13 is a schematic diagram of the half-wave voltage regulator circuitry mounted to the stator in accordance with the present invention.

FIG. 13 is a schematic diagram 120 of the half-wave voltage regulator circuitry mounted to the stator in accordance with the present invention. The two half-wave voltage regulator circuits can be connected together to form a full-wave voltage regulator circuit for battery charging. The half-wave voltage regulator circuit preferably includes a finned heat sink for better cooling. Two half wave regulator circuitry may be mounted on the stator to form full wave regulator circuitry. Most prior art regulator circuits use SCRs, while the regulator circuit of the present invention uses IGBTs.

Figure 14:
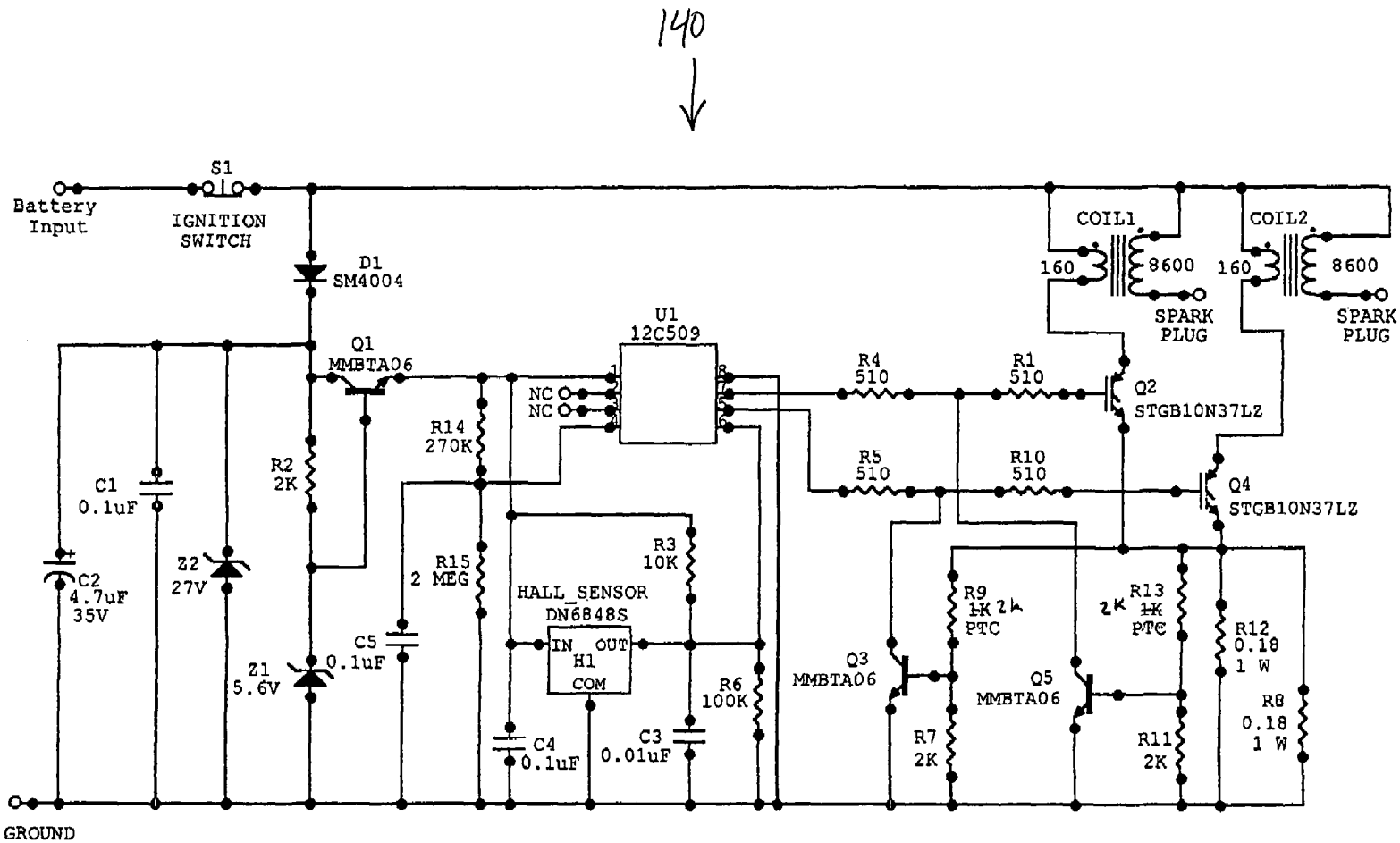
FIG. 14 is a schematic diagram of the ignition circuitry mounted to the stator in accordance with the present invention.

FIG. 14 is a schematic diagram 140 of the ignition circuitry mounted to the stator in accordance with the present invention. Ignition circuitry is provided for single or two cylinder engines. The ignition circuitry is preferably mounted within one of the openings in the central core of the stator.

The ignition circuitry includes a controller section and a driver section. The circuitry preferably includes a microcontroller and a ramp-and-fire-type-ignition coil charging system that allows for changing the current levels to which the coil charges, thus providing higher energy levels, higher coil open circuit output levels, and longer ignition spark durations.

The present invention provides a more versatile ignition system allowing the engine to burn other types of fuels, other than gasoline, like propane. The ignition system is a microcontroller controlled ignition allowing software changes to be made to accommodate customer needs. The ignition system uses a ramp and fire type ignition coil charging system that allows for changing the current levels to which the coil charges, thus providing higher energy levels, higher coil open circuit output kilovolt levels and longer ignition spark durations. The ignition system provides for advancing the ignition spark which provides horsepower gains from an engine. The ignition system also provides longer spark durations which provide more through burning of the air-fuel mixture resulting in lower emissions for pollution control. The present invention also provides for ignition triggering by the use of a Hall Sensor, thus making manufacturing simpler and less costly by eliminating small air gaps and tight tolerances. With ignition circuitry mounted on stator you eliminate the magnet on the flywheel. Magnet for ignition trigger is mounted to stator. Therefore, flywheel doesn't require magnets.

Test data of engine temperature taken on a prior art 18-pole stator and flywheel assembly mounted on a 20 HP twin cylinder engine. The prior art system comprises an 18-pole stator with two magneto ignitions and no openings in the flywheel. The load includes the power take-off (PTO) on, the lights on and the battery charging, for a total load current of approximately 11 amps. The temperature was monitored and recorded on the cylinder fin, the rear engine block stator, and the oil plug. Test data of engine temperature taken on the 24-pole stator and flywheel assembly of the present invention mounted on a 20 HP twin cylinder engine. As can be observed from the results, the engine temperatures for the stator and flywheel assembly of the present invention are cooler than those for the prior art assembly by approximately 40 to 50 degrees Celsius.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention.

The invention claimed is:

1. An ignition and charging system for an internal combustion engine comprising:

a stator mountable to the internal combustion engine, the stator having a plurality of poles extending radially outwardly from a central core, the stator having large central core with at least one opening extending therethrough for accepting a regulator module or a stator tray assembly that is attachable to the stator for mounting electronic circuitry thereto;

at least one layer of wire coil windings wound around each pole of the stator; and a flywheel mountable to a crankshaft of the internal combustion engine above the stator and rotatable around the poles of the stator, the flywheel having a plurality of openings extending therethrough.

2. The system of claim 1, wherein the stator is preferably made from a plurality of steel laminations that are stamped and connected together.

3. The system of claim 1, wherein the large central core increases heat dissipation.

4. The system of claim 1, wherein the stator includes at least 24 poles.

5. The system of claim 1, wherein the stator poles are short and close together.

6. The system of claim 1, wherein the stator poles are the same length.

7. The system of claim 1, wherein the stator poles are of various different lengths providing for different coil windings for different applications.

8. The system of claim 7, wherein the shorter stator poles include coil windings for high current battery charging applications.

9. The system of claim 7, wherein the longer stator poles include coil windings for battery-less ignition applications.

10. The system of claim 1, wherein the stator includes one layer of wire wound around each pole of the stator resulting in fewer windings per pole.

11. The system of claim 1, wherein the large central core reduces magnetic flux resistance.

12. The system of claim 1, further comprising ignition circuitry mounted to the central core of the stator.

13. The system of claim 1, further comprising voltage regulator circuitry mounted to the central core of the stator.

14. The system of claim 13, wherein the regulator circuitry includes two half-wave voltage regulator circuits connected together to form a full-wave voltage regulator circuit for battery charging.

15. The system of claim 13, wherein the regulator circuitry includes at least one heat sink for improving cooling.

16. The system of claim 1, wherein the at least one opening is for mounting ignition and regulator circuitry therein.

17. The system of claim 1, wherein the electronic circuitry includes ignition and regulator circuitry mounted to the central core of the stator.

18. The system of claim 1, wherein the flywheel is balanced.

19. The system of claim 1, wherein the flywheel is symmetrical.

20. The system of claim 1, wherein the openings in the flywheel provide increased airflow through the engine.

21. The system of claim 1, wherein the openings in the flywheel provide increased cooling through the engine.

22. The system of claim 1, wherein the openings in the flywheel reduce the weight of the flywheel.

23. The system of claim 1, wherein the openings in the flywheel lower the inertia of the flywheel.

24. The system of claim 1, wherein the openings in the flywheel provide for faster acceleration.

25. The system of claim 1, wherein the openings in the flywheel provide for faster deceleration.

26. The system of claim 1, wherein the openings in the flywheel provide for better fuel economy from the engine.

27. The system of claim 1, wherein the openings in the flywheel provide for lower emissions from the engine.

28. The system of claim 1, wherein the openings in the flywheel provide for more horsepower from the engine.

29. The system of claim 1, wherein the regulator module includes at least one heat sink with cooling fins.

30. The system of claim 1, further comprising a regulator housing that is attachable to the tray assembly for mounting electronic circuitry thereto.

31. The system of claim 30, wherein the regulator housing includes at least one heat sink with cooling fins.

32. A radial stator and flywheel assembly comprising:

a stator mountable to an internal combustion engine, the stator having a plurality of poles extending radially outwardly from a central core, the stator having a large central core with at least one opening extending therethrough for accepting a regulator module or a stator tray assembly that is attachable to the stator for mounting electronic circuitry thereto;

one layer of wire coil windings wound around each pole of the stator; and a flywheel mountable to the crankshaft of the internal combustion engine above the stator and rotatable around the poles of the stator, the flywheel having a plurality of openings extending therethrough.

33. The assembly of claim 32, wherein the stator includes at least 24 poles.

34. The assembly of claim 32, wherein the stator poles are the same length.

35. The assembly of claim 32, wherein the stator poles are of various different lengths providing for different coil windings for different applications.

36. The assembly of claim 32, wherein the electronic circuitry includes voltage regulator circuitry and ignition circuitry.

37. The assembly of claim 36, wherein the voltage regulator circuitry includes two half-wave voltage regulator circuits connected together to form a full-wave voltage regulator circuit for battery charging.

38. The assembly of claim 36, wherein the voltage regulator circuitry includes at least one heat sink for improving cooling.

39. The assembly of claim 32, wherein the openings in the flywheel provide increased airflow through the engine.

40. The assembly of claim 32, wherein the openings in the flywheel provide increased cooling through the engine.

41. The assembly of claim 32, wherein the openings in the flywheel reduce the weight of the flywheel.

42. The assembly of claim 32, wherein the openings in the flywheel lower the inertia of the flywheel.

43. The assembly of claim 32, wherein the openings in the flywheel provide for faster acceleration.

44. The assembly of claim 32, wherein the openings in the flywheel provide for faster deceleration.

45. The assembly of claim 32, wherein the openings in the flywheel provide for better fuel economy from the engine.

46. The assembly of claim 32, wherein the openings in the flywheel provide for lower emissions from the engine.

47. The assembly of claim 32, wherein the openings in the flywheel provide for more horsepower from the engine.

* * * * *